US007140060B1

(12) United States Patent
Walker

(10) Patent No.: US 7,140,060 B1
(45) Date of Patent: Nov. 28, 2006

(54) APPARATUS FOR CLEANING FLOOR SURFACES

(76) Inventor: Freddie Walker, 3199 Marion Pl., Columbus, OH (US) 43227

( * ) Notice: Subject to any disclaimer, the term of this patent is extended or adjusted under 35 U.S.C. 154(b) by 0 days.

(21) Appl. No.: 11/178,820

(22) Filed: Jul. 12, 2005

(51) Int. Cl.
*A47L 11/12* (2006.01)
*A47L 11/14* (2006.01)

(52) U.S. Cl. ..... 15/98; 15/79.2

(58) Field of Classification Search ..... 15/49.1, 15/98, 79.1, 79.2
See application file for complete search history.

(56) References Cited

U.S. PATENT DOCUMENTS 4,137,601 A 2/1979 Eschenbach
5,674,120 A * 10/1997 Legatt et al. ..... 451/350
6,185,776 B1 * 2/2001 Windmeisser ..... 15/49.1

* cited by examiner

*Primary Examiner*—Randall Chin
(74) *Attorney, Agent, or Firm*—Crossley Patent Law; Mark Crossley

(57) ABSTRACT

An apparatus for cleaning floor surfaces. The apparatus comprises a floor buffing machine that has both a handle portion and a main body. The main body has a bottom-mounted buffer pad and a top-mounted motor which is connected to a control box located on the handle portion. The motor can be set in one of two different positions that either allow the buffer pad to perform in a rotary mode or an oscillating mode.

5 Claims, 4 Drawing Sheets

APPARATUS FOR CLEANING FLOOR SURFACES

BACKGROUND OF THE INVENTION

The present invention concerns that of a new and improved apparatus for cleaning floor surfaces.

DESCRIPTION OF THE PRIOR ART

U.S. Pat. No. 4,137,601, filed by Eschenbach, discloses a device for scrubbing carpets having an augularly oscillating scrubber mounted on a frame.

U.S. Pat. No. 4,809,385, filed by Bogue, discloses an apparatus for imparting a high gloss to a floor.

U.S. Pat. No. 3,715,772, filed by Downing et al., discloses an auxiliary attachment for rotary floor treatment machines.

U.S. Pat. No. D344,163, filed by Joines, discloses an ornamental design for a floor buffing machine.

U.S. Pat. No. 4,137,601, filed by Eschenbach, discloses a scrubbing device attachable to rotary power sources comprising a stationary portion, a drive portion, an oscillating portion, and an abrasive portion.

SUMMARY OF THE INVENTION

The present invention concerns that of a new and improved apparatus for cleaning floor surfaces. The apparatus comprises a floor buffing machine that has both a handle portion and a main body. The main body has a bottom-mounted buffer pad and a top-mounted motor which is connected to a control box located on the handle portion. The motor can be set in one of two different positions that either allow the buffer pad to perform in a rotary mode or an oscillating mode.

There has thus been outlined, rather broadly, the more important features of an apparatus for cleaning floor surfaces that the detailed description thereof that follows may be better understood and in order that the present contribution to the art may be better appreciated. There are, of course, additional features of the apparatus for cleaning floor surfaces that will be described hereinafter and which will form the subject matter of the claims appended hereto.

In this respect, before explaining at least one embodiment of the apparatus for cleaning floor surfaces in detail, it is to be understood that the apparatus for cleaning floor surfaces is not limited in its application to the details of construction and to the arrangements of the components set forth in the following description or illustrated in the drawings. The apparatus for cleaning floor surfaces is capable of other embodiments and being practiced and carried out in various ways.

Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present apparatus for cleaning floor surfaces. It is important, therefore, that the claims be regarded as including such equivalent constructions insofar as they do not depart from the spirit and scope of the present invention.

It is therefore an object of the present invention to provide an apparatus for cleaning floor surfaces which has all of the advantages of the prior art and none of the disadvantages.

It is another object of the present invention to provide an apparatus for cleaning floor surfaces which may be easily and efficiently manufactured and marketed.

It is another object of the present invention to provide an apparatus for cleaning floor surfaces which is of durable and reliable construction.

It is yet another object of the present invention to provide an apparatus for cleaning floor surfaces which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
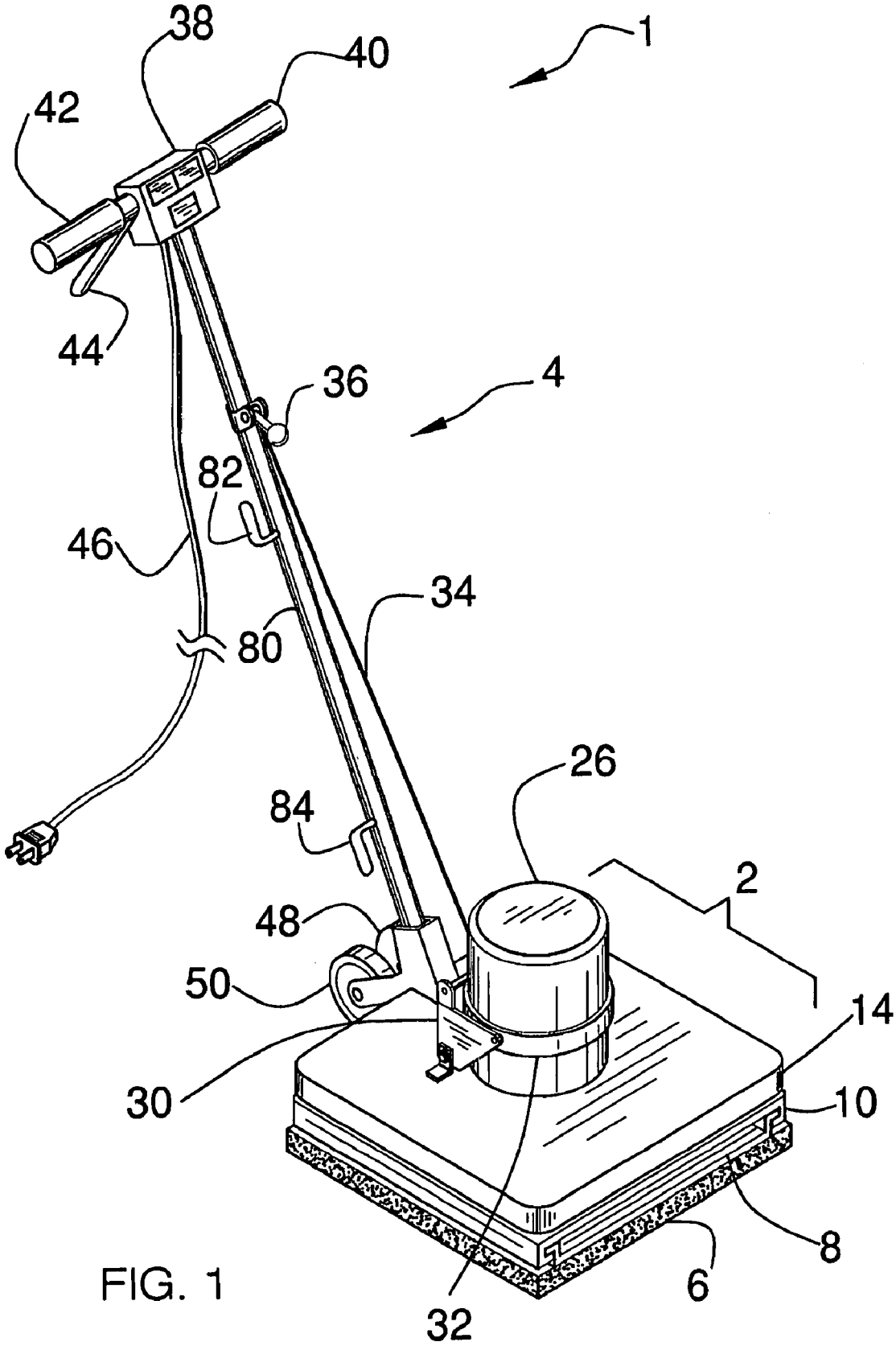
FIG. 1 shows a perspective view of the apparatus for cleaning floor surfaces.
Figure 2:
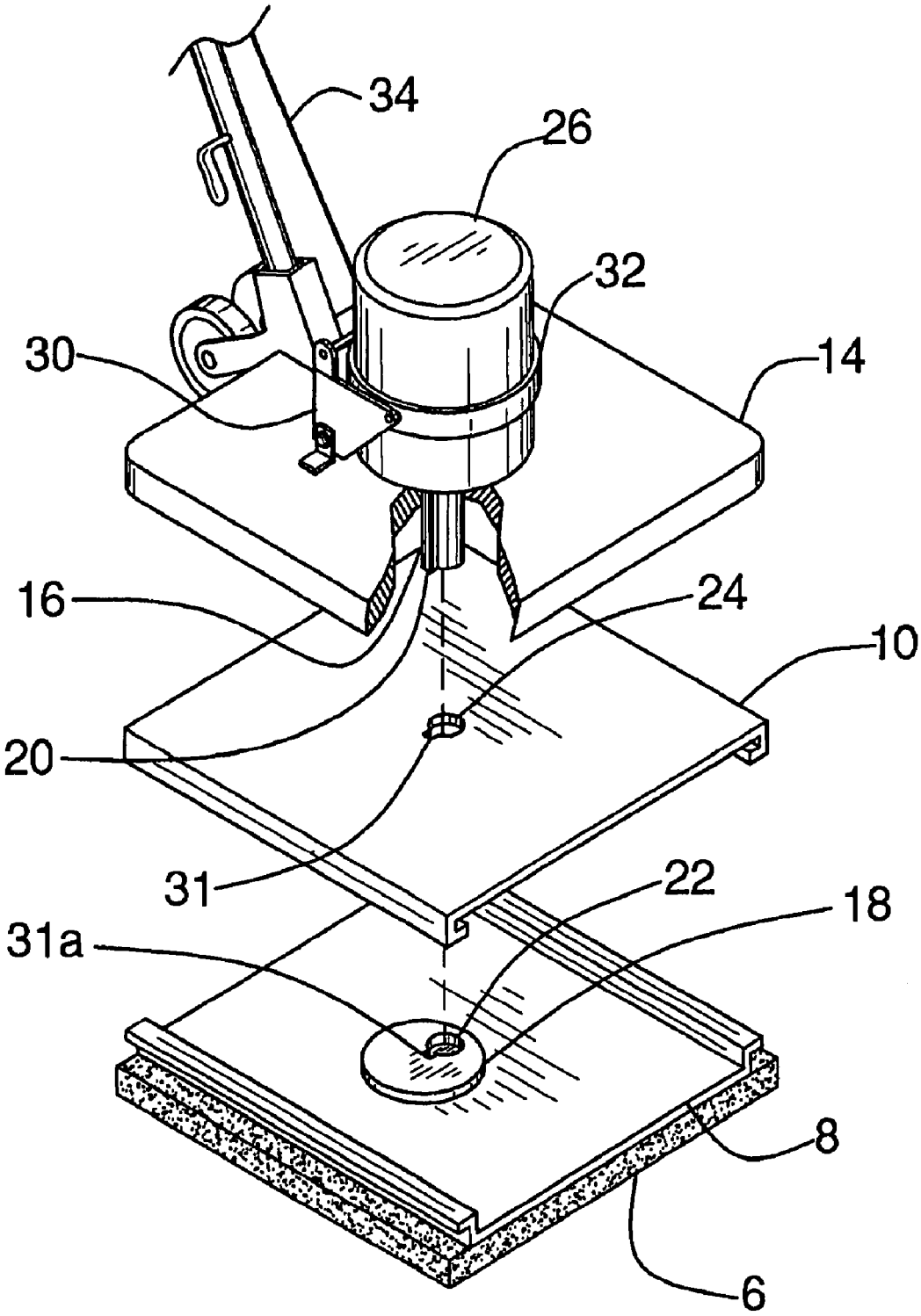
FIG. 2 shows a perspective view of the components of the main body of the apparatus for cleaning floor surfaces.
Figure 3:
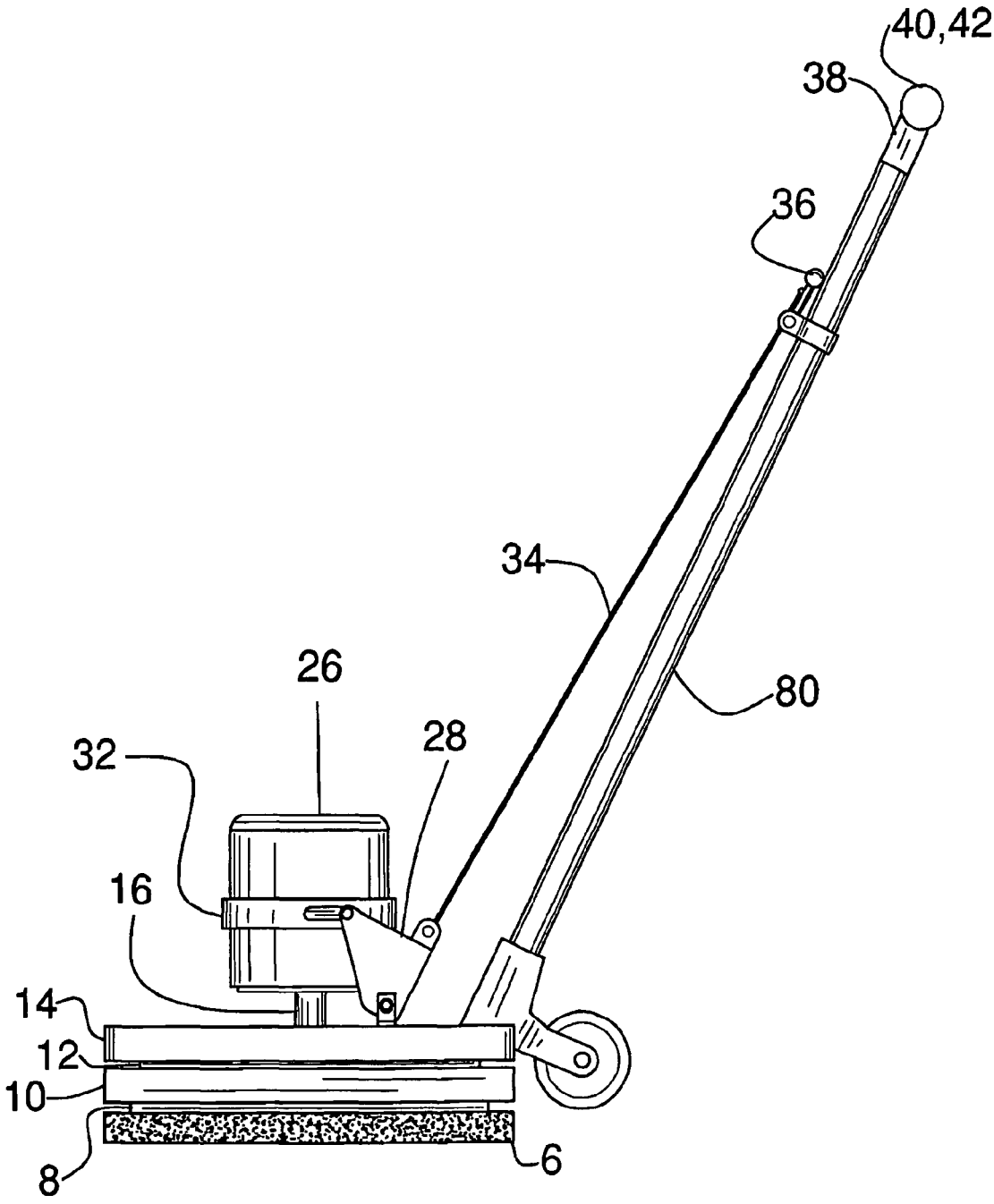
FIG. 3 shows a side view of the apparatus for cleaning floor surfaces.

With reference now to the drawings, and in particular to FIGS. 1 through 5 thereof, a new apparatus 1 for cleaning floor surfaces embodying the principles and concepts of the present invention will be described.

As best illustrated in FIGS. 1 through 5, the apparatus 1 for cleaning floor surfaces generally comprises a main body 2 and a handle unit 4 attached thereto. The main body 2 comprises several various components. The bottom-most element within the main body 2 comprises a buffer pad 6 that has two surfaces, a top surface and a bottom surface. Next, the main body 2 comprises a top plate 10 and a bottom plate 8, which each have two surfaces, a top surface and a bottom surface. The bottom surface of the bottom plate 8 is attached to the buffer pad 6. The bottom surface of the top plate 10 is removably attached to the top surface of the bottom plate 8.

On the top surface of the bottom plate 8 is located a reciprocating disc 18, which has a hole 18 located in it. Furthermore, the middle of the top plate 10 has a hole 24. Each of the holes are circular with the exception of small extra cutouts 31 and 31*a* located in the holes 24 and 22, respectively, with these holes allowing placement of the motor shaft 16 and its accompanying nodule 20. While the hole 22 on the reciprocating disc 18 itself is centered in relation to the bottom plate 8 as a whole, the hole 22 is offset on the reciprocating disc, resulting in the reciprocating disc 18 itself not being centered on the top surface of the bottom plate 8.

A plastic bearing plate 12 is located on the top surface of the top plate 10. A mounting plate 14 has two surfaces, a top surface and a bottom surface, with the bottom surface of the mounting plate 14 being attached to the top plate 10.

Motor 26 is located on the top surface of the mounting plate 14, with the motor 26 having a downwardly-sloped motor shaft 16. The motor shaft 16 is circular except for an attached nodule 20, with the nodule 20 fitting in the cutouts 31 and 31*a* of holes 24 and 22, respectively, while the motor shaft 16 itself fits into the holes 22 and 24. Motor 26 is kept fixedly attached to the top surface of the mounting plate 14 both by a pair of brackets 28 and 30 and also by a circular band 32 that encircles the motor 26.

The brackets are pivotally attached to the top surface of the mounting plate 14 and are attached to one another by a lift bar 35. A lift cable 34 having two ends, a top end and a bottom end, has bottom end attached to the lift bar 35 and the top end attached to a lift handle 36 that is attached to the handle unit 4 of the apparatus 1. By activating the lift handle 36, an individual can place the motor shaft 16 of the motor 26 into one of two different positions, thereby altering how the buffer pad 6 rotates when the motor 26 is turned on.

The handle unit 4 has a main handle 80 that has two ends, a top end and a bottom end, with the bottom end of the handle 80 being attached to the mounting plate 14. The top end of the main handle 80 has a pair of grasping handles 40 and 42, and also a centrally mounted control box 38. The control box 38 is electronically connected to the motor 26 and receives power through a power cord 46, with the power preferably being standard household current.

Attached to the grasping handles is an activation lever 44, with the activation lever 44 serving as a circuit in between the motor 26 and the power cord 46. Once the activation lever 44 is depressed and the control box 38 is properly configured, the motor 26 will commence spinning the motor shaft 16 in an axial manner. If the activation lever 44 is released, then the motor 26 will stop functioning.

The apparatus 1 also has a pair of wheels 48 and 50, which are connected to the bottom end of the main handle 80. Furthermore, a pair of cord holders 82 and 84 are attached to the main handle 80, with these cord holders 82 and 84 being used to properly store the power cord 46 when the apparatus 1 is not in use.

Figure 4:
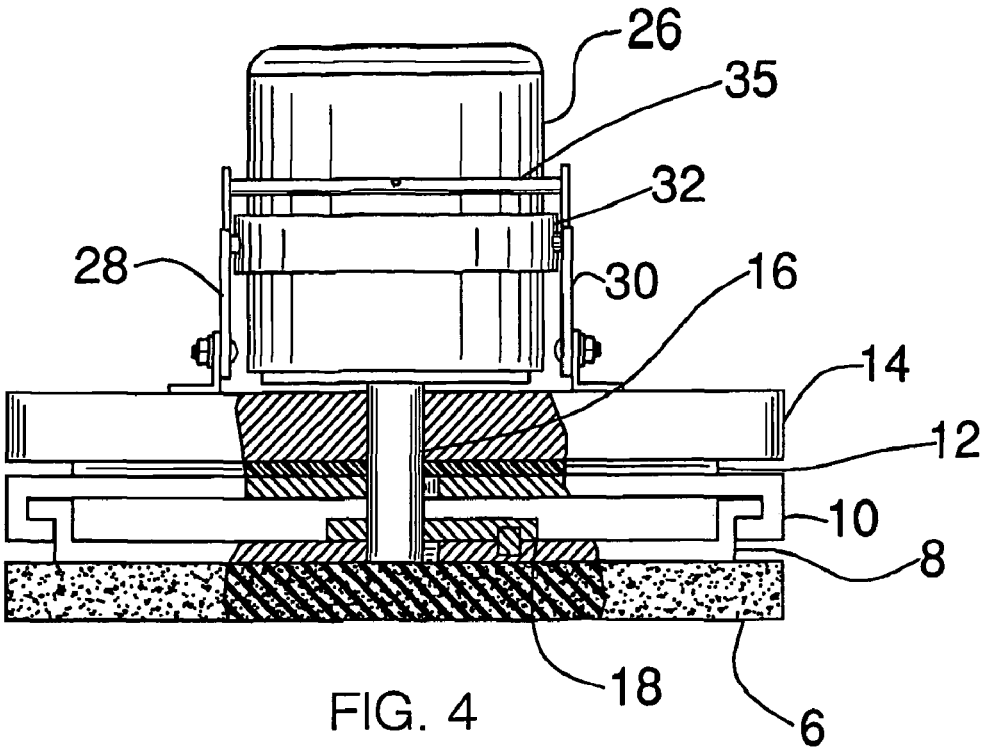
FIG. 4 shows an end view of the main body of the apparatus for cleaning floor surfaces as it would appear in the oscillating mode.

The apparatus 1 has two different operational modes. If an individual wants to use the apparatus 1 in more of a cleaning mode, then the lift handle 36 is placed in a downward position, allowing the motor shaft 16 to be placed through both holes 22 and 24. Since the reciprocating disc 18 is off-center and the motor shaft 16 travels into reciprocating disc 18 through the hole 22, the entire portion of the main body 2 that is below the mounting plate 14 will rotate in a circular, off-center manner, allowing the buffer pad 6 to perform cleaning functions. This positioning of the motor 26 is shown in FIG. 4.

If an individual wants to use the apparatus 1 in more of a buffing mode, then the lift handle 36 is placed in an upward position, allowing the motor shaft 16 to be placed only through hole 24.

Figure 5:
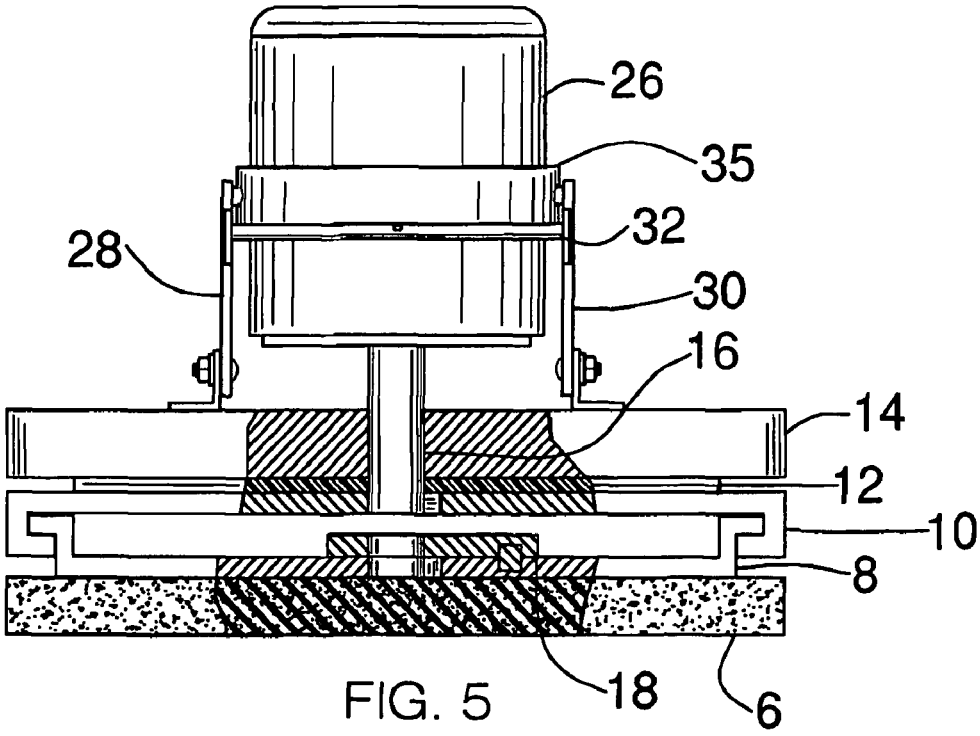
FIG. 5 shows an end view of the main body of the apparatus for cleaning floor surfaces as it would appear in the rotary mode.

Since the hole 24 is centrally located on the top plate 10, the entire portion of the main body 2 that is below the mounting plate 14 will rotate in a circular and centered manner, allowing the buffer pad 6 to best be utilized in buffering operations. This positioning of the motor 26 is shown in FIG. 5.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Although this invention has been described in its preferred forms with a certain degree of particularity, it is understood that the present disclosure of the preferred form has been made by way of example and numerous changes in the details of construction and combination and arrangement of parts may be resorted to without departing from the spirit and scope of the invention.

What I claim as my invention is:

1. An apparatus for cleaning floor surfaces comprising:

(a) a buffer pad having two surfaces, a top surface and a bottom surface, (b) a pair of plates comprising a top plate and a bottom plate, each of the plates having two surfaces, a top surface and a bottom surface, the bottom surface of the bottom plate being attached to the top surface of the buffer pad, the bottom surface of the top plate being removably attached to the top surface of the bottom plate, (c) a reciprocating disc attached to the top surface of the bottom plate, (d) a first hole located in the reciprocating disc, the first hole being circular, the first hole having an extra cutout area within it, (e) a second hole located in the middle of the top plate, the second hole having an extra cutout area within it, (f) a plastic bearing plate located on the top surface of the top plate, (g) a mounting plate having two surfaces, a top surface and a bottom surface, the bottom surface of the mounting plate being attached to the plastic bearing plate, (h) a motor located on the top surface of the mounting plate, the motor including a downwardly-sloped motor shaft, the motor shaft being circular, the motor shaft also having a nodule, the nodule fitting into the cutout area within the first and second holes when the motor shaft is inserted through the first and second holes, (i) means for mounting the motor onto the top surface of the mounting plate, (j) a handle unit, the handle unit including a main handle, the main handle including two ends, a top end and a bottom end, the bottom end of the main handle being attached to the mounting plate, (k) a lift handle attached to the main handle, (l) means for raising and lowering the motor in relation to the top surface of the mounting plate, (m) a pair of grasping handles attached to the top end of the main handle, (n) a control box attached to the top end of the main handle, the control box being electronically connected to the motor, (o) an activation lever attached to the pair of grasping handles, (p) power means for providing power to the control box, the power means being connected to the control box, (q) a pair of wheels attached to the bottom end of the main handle, (r) wherein the activation lever serves as a circuit in between the power means and the motor, (s) further wherein the motor can be placed into one of two positions to operate the apparatus.

2. An apparatus for cleaning floor surfaces according to claim 1 wherein the means for mounting the motor onto the top surface of the mounting plate further comprises:

(a) a pair of brackets pivotally attached to the motor, the pair of brackets also pivotally attached to the top surface of the mounting plate, and (b) a circular band that encircles the motor.

3. An apparatus for cleaning floor surfaces according to claim 2 wherein the means for raising and lowering the motor in relation to the top surface of the mounting plate further comprises:

(a) a lift bar connected to each of the brackets of the pair of brackets, (b) a lift cable having two ends, a top end and a bottom end, the bottom end of the lift cable being attached to the lift bar, the top end of the lift cable being attached to the lift handle, (c) wherein lifting the lift handle causes the motor to rise to a higher position, and (d) further wherein lowering the lift handle causes the motor to lower to a lower position.

4. An apparatus for cleaning floor surfaces according to claim 3 wherein the power means further comprises:

(a) a power cord, the power cord being connected to the control box, (b) wherein the power cord receives power through standard household current.

5. An apparatus for cleaning floor surfaces according to claim 4 wherein the apparatus further comprises a pair of cord holders, the pair of cord holders comprising a first cord holder and a second holder, wherein each of the cord holders of the pair of cord holders being attached to the main handle of the handle unit.

* * * * *